US007665776B2

(12) United States Patent
Lang

(10) Patent No.: US 7,665,776 B2
(45) Date of Patent: Feb. 23, 2010

(54) HANDLE FOR VEHICLE DOOR

(75) Inventor: Steven C. Lang, Columbus, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 50 days.

(21) Appl. No.: 11/682,926

(22) Filed: Mar. 7, 2007

(65) Prior Publication Data

US 2008/0217942 A1 Sep. 11, 2008

(51) Int. Cl.
*E05B 3/00* (2006.01)

(52) U.S. Cl. ..... 292/336.3; 292/DIG. 23

(58) Field of Classification Search ..... 292/336.3, 292/DIG. 23, 216, DIG. 38, 348, DIG. 22, 292/DIG. 65; 70/237, 207; 273/317.2; 74/500.5, 74/501.6

See application file for complete search history.

(56) References Cited

U.S. PATENT DOCUMENTS

| | | | | |
|---|---|---|---|---|
| 2,469,178 | A * | 5/1949 | Salvans | 87/6 |
| 4,475,754 | A | 10/1984 | Arlauskas et al. | |
| 4,482,179 | A * | 11/1984 | Johnson | 292/336.3 |
| 4,886,310 | A | 12/1989 | Cry et al. | |
| 5,123,687 | A * | 6/1992 | Pfeiffer et al. | 292/336.3 |
| 5,791,703 | A * | 8/1998 | Kritzler et al. | 292/336.3 |
| 5,996,382 | A * | 12/1999 | Lehmkuhl | 70/256 |
| 6,158,788 | A * | 12/2000 | Ikeda et al. | 292/216 |
| 6,189,267 | B1 | 2/2001 | Staser | |
| 6,464,270 | B1 | 10/2002 | Sloan et al. | |
| 6,612,630 | B1 * | 9/2003 | Meinke | 292/348 |
| 6,880,870 | B2 | 4/2005 | Costigan | |
| 6,964,439 | B2 * | 11/2005 | Nomura et al. | 292/336.3 |
| 7,059,641 | B2 | 6/2006 | Chanya | |
| 7,302,818 | B2 * | 12/2007 | Usuzaki et al. | 70/256 |
| 2002/0059693 | A1 * | 5/2002 | Jooss et al. | 16/412 |
| 2002/0070567 | A1 * | 6/2002 | Ciborowski et al. | 292/336.3 |
| 2005/0146145 | A1 * | 7/2005 | Koch et al. | 292/216 |
| 2005/0218666 | A1 * | 10/2005 | Odahara et al. | 292/336.3 |
| 2006/0038417 | A1 * | 2/2006 | Pudney | 292/336.3 |
| 2006/0119524 | A1 * | 6/2006 | March et al. | 343/713 |
| 2007/0001467 | A1 * | 1/2007 | Muller et al. | 292/336.3 |
| 2008/0018127 | A1 * | 1/2008 | Schindler et al. | 296/1.02 |

FOREIGN PATENT DOCUMENTS

| | | |
|---|---|---|
| EP | 0942131 A1 | 9/1999 |
| EP | 1079048 A1 | 2/2001 |
| FR | 2809444 A1 | 1/2001 |

* cited by examiner

*Primary Examiner*—Peter M Cuomo
*Assistant Examiner*—Kristina R Fulton

(57) ABSTRACT

An handle assembly for a vehicle door and method of actuating a release mechanism, such as a door latch, are disclosed. The handle assembly may have a pull handle including a sliding leg, a pivot leg and a hand gripping portion extending between the sliding leg and the pivot leg, with the sliding leg adapted to guide the pull handle between a closed position and an open position, and with the pivot leg adapted to be secured for pivoting about a handle pivot axis about which the pull handle is pivotable. The handle assembly may also include a torque cable having a first end centered and rotatable about the handle pivot axis, and a second end adapted to operatively engage the release mechanism, with the first end rotationally fixed to the pivot leg.

19 Claims, 2 Drawing Sheets

HANDLE FOR VEHICLE DOOR

BACKGROUND OF THE INVENTION

The present application relates generally to a handle assembly for a vehicle door, and more particularly to a pull type handle.

For vehicle doors with a movable window glass, there is a need to assure that any mechanisms and other components within the vehicle door do not interfere with the movement of the glass. Accordingly, for mechanisms such as an outside door handle assembly, a minimum clearance is set between the window glass and the closest component of the door handle assembly, creating a packaging restriction. This packaging restriction, then, defines the minimum distance the outer door surface can be from the window.

A typical outside handle assembly for a vehicle door includes a bell crank that is used to activate a push cable or wire rod link to a latch assembly. The bell crank tends to extend a significant distance inward from the vehicle door outer panel, thus necessitating a large gap between the window glass and vehicle door outer panel. The packaging restriction, then, may cause the overall thickness of the vehicle door to be significantly greater than would otherwise be necessary.

SUMMARY OF THE INVENTION

An embodiment contemplates a handle assembly for a vehicle door. The handle assembly may comprise a pull handle including a sliding leg, a pivot leg and a hand gripping portion extending between the sliding leg and the pivot leg. The sliding leg may be adapted to guide the pull handle between a closed position and an open position, and the pivot leg may be adapted to be secured for pivoting about a handle pivot axis about which the pull handle is pivotable. The handle assembly may also comprise a torque cable having a first end centered and rotatable about the handle pivot axis, and a second end adapted to operatively engage a release mechanism, with the first end rotationally fixed to the pivot leg.

An embodiment contemplates a vehicle door that may comprise a door outer panel including a handle pocket located between a slider hole and a pivot hole; a pull handle including a sliding leg extending through the slider hole, a pivot leg extending through the pivot hole, and a hand gripping portion extending between the sliding leg and the pivot leg, with the sliding leg adapted to guide the pull handle between a closed position and an open position, and with the pivot leg secured relative to the door outer panel for pivoting about a handle pivot axis about which the pull handle is pivotable; and a torque cable having a first end centered and rotatable about the handle pivot axis, and a second end operatively engaging a door latch assembly, with the first end rotationally fixed to the pivot leg.

An embodiment contemplates a method of actuating a door latch assembly of a vehicle door comprising the steps of: providing a pull handle pivotable about a handle pivot axis between a closed position and an open position; providing a torque cable having a first end pivotable by the pull handle about the handle pivot axis and a second end operatively engaging the door latch assembly; pivoting the pull handle from the closed position to the open position; and rotating the first end of the torque cable as the pull handle is pivoted from the closed position to the open position, inducing a torque in the second end of the torque cable.

An advantage of an embodiment is that the handle assembly helps reduce the overall packaging space required for the door handle assembly inside the door.

An advantage of an embodiment is that the handle assembly, by minimizing its protrusion inboard from the vehicle door outer panel, allows the window glass to be closer to the vehicle door outer panel, thus allowing for a reduced overall door thickness. A reduced overall door thickness may decrease the weight of the door, allow for greater flexibility in door styling, provide more room to solve other door packaging concerns, or provide more interior vehicle room.

An advantage of an embodiment is that the handle assembly may allow for improved handle pull efforts relative to a conventional bell crank type of pull handle.

An advantage of an embodiment is that a simple handle assembly is provided that is employed to transmit a torque generated by pivoting of the handle, through a torque cable, to a release mechanism to actuate the release mechanism. This handle assembly is particularly advantageous when employed as an outside handle assembly on a vehicle door that is used to release the door latch assembly.

DETAILED DESCRIPTION

Figure 1:
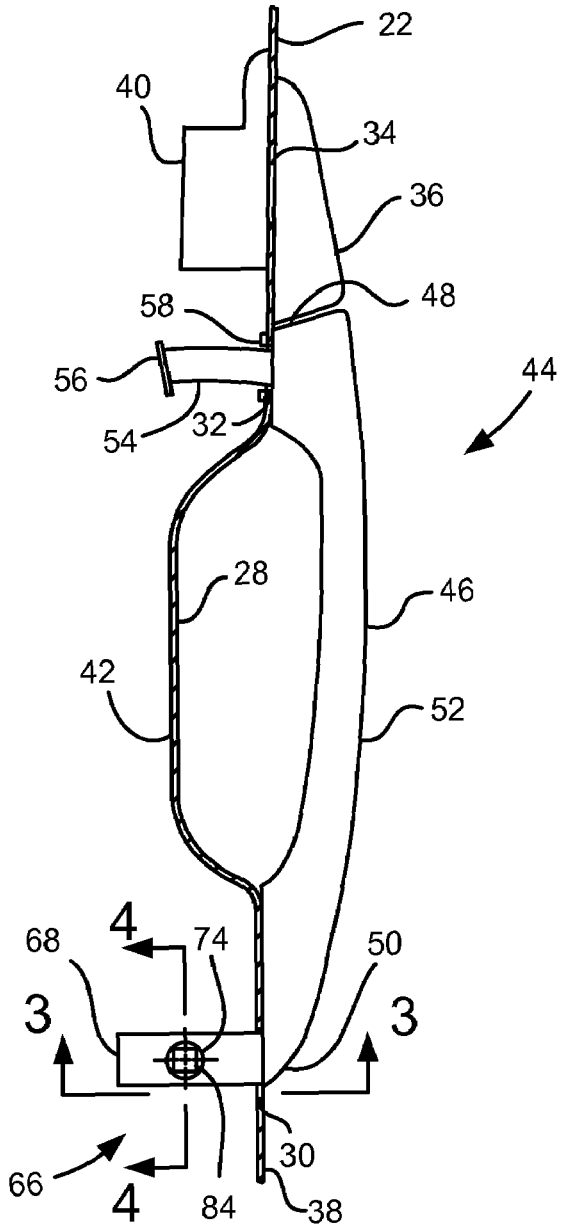
FIG. 1 is a schematic plan view of an outside handle assembly for a vehicle door, in a closed position.

FIGS. 1-4 illustrate a portion of a vehicle door 20 having a door outer panel 22, inner door structural members 24, and window glass 26 mounted therebetween. The door outer panel 22 includes a handle pocket 28 located between a pivot hole 30 and a slider hole 32. The door outer panel 22 may also include a key hole 34, having a key bezel 36 mounted on an exterior surface 38 of the outer panel 22 and a key cylinder assembly 40 mounted on an inner surface 42 of the door outer panel 22. Of course, the key hole 34, key bezel 36, and key cylinder assembly 40 are optional, since outside door handles (discussed below) may be used on doors without a key cylinder, such as is commonly the case with rear doors on a four door sedan style of vehicle or interior compartment doors (not shown) in the vehicle.

An outside handle assembly 44 includes a pull handle 46 that is located on the exterior surface 38 of the outer panel 22 adjacent to the handle pocket 28. The pull handle 46 includes a sliding leg 48 that extends through the slider hole 32, a pivot leg 50 that extends through the pivot hole 30, and a hand gripping portion 52, which extends between the sliding leg 48 and the pivot leg 50 and is aligned with the handle pocket 28.

Figure 2:
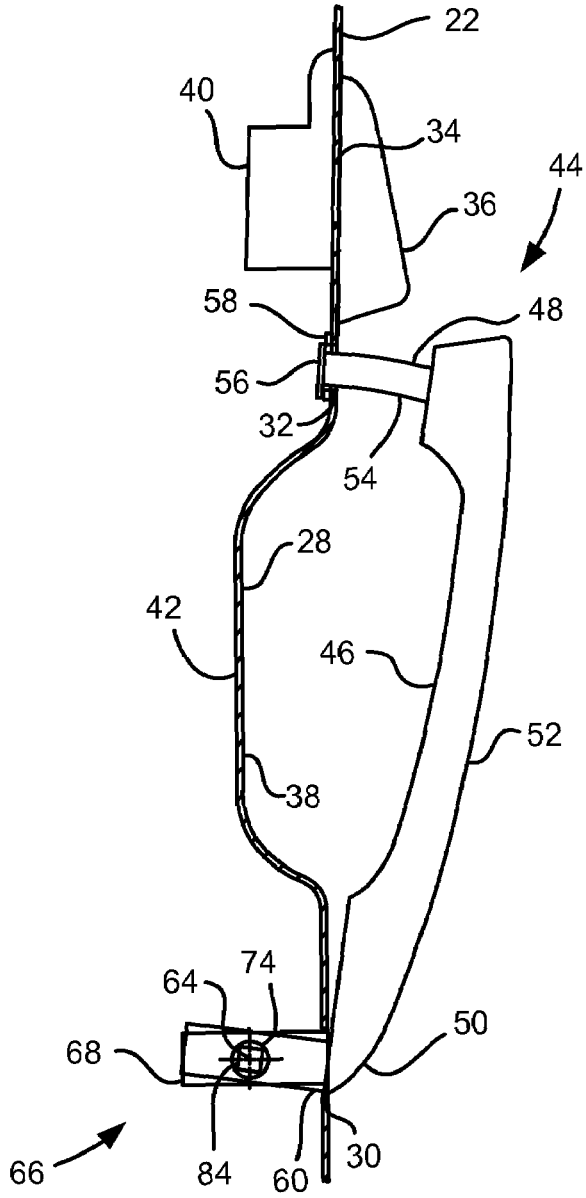
FIG. 2 is a schematic plan view similar to FIG. 1, but showing the outside handle assembly in an open position.
Figure 3:
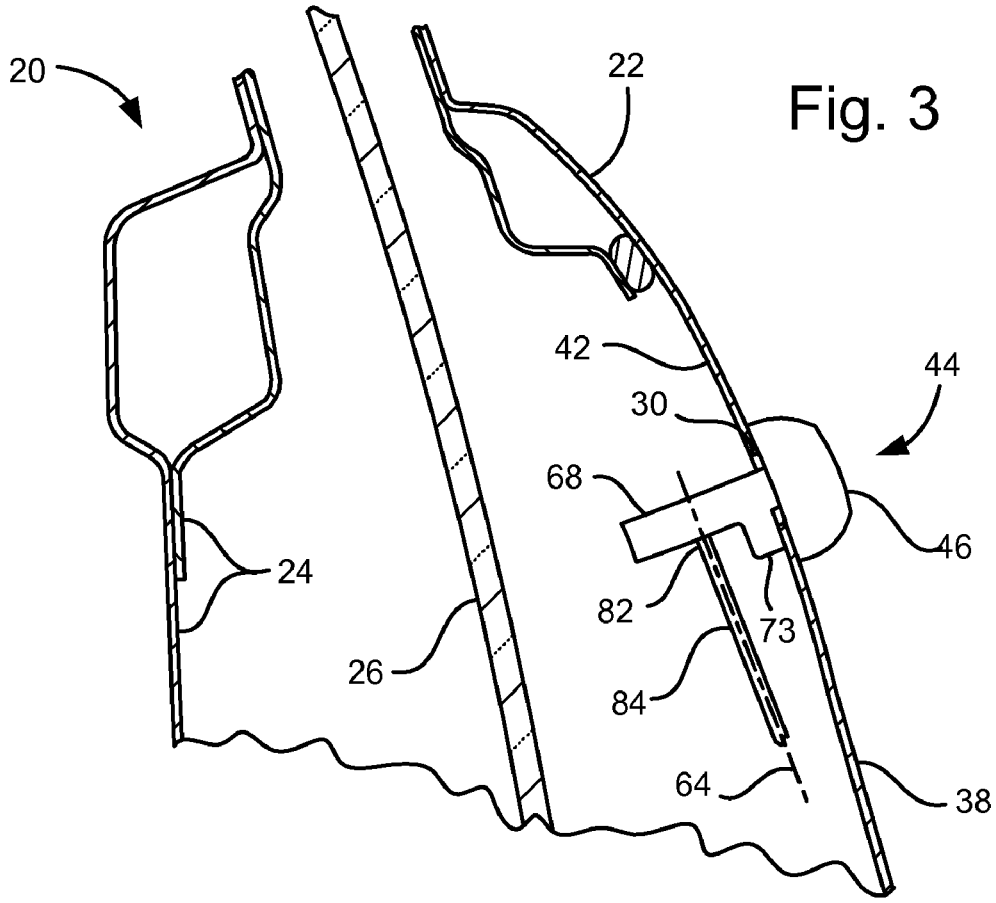
FIG. 3 is a view, taken along line 3-3 in FIG. 1, schematically illustrating a portion of the vehicle door and outside handle assembly.
Figure 4:
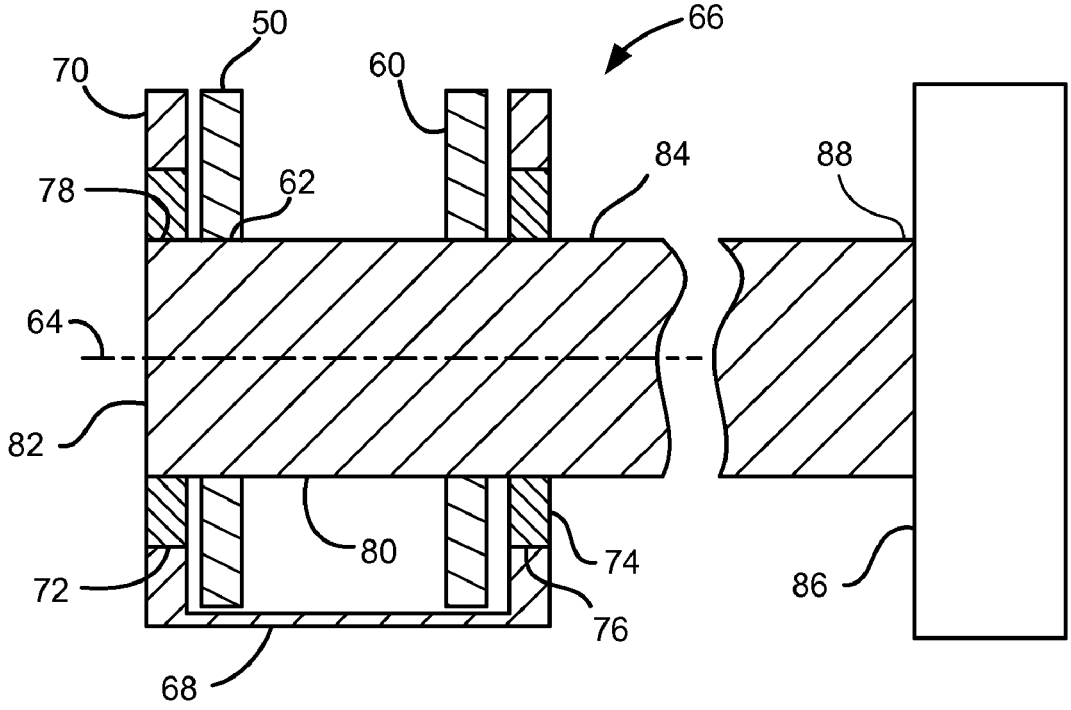
FIG. 4 is a schematic section view taken along line 4-4 in FIG. 1.

The sliding leg 48 includes a guide portion 54 that may be curved to guide the path of the sliding leg end of the pull handle 46 as it moves horizontally between the closed position (FIG. 1) and the open position (FIG. 2). The sliding leg 48 also includes a stop flange 56, mounted to the end of the guide portion 54. The stop flange 56 engages with a stop block 58 located on the inner surface 42 of the door outer panel 22 to define the maximum extent of travel of the pull handle 46 in its open position.

The pivot leg 50 includes a pair of spaced apart flanges 60 extending through the pivot hole 30 into the door 20. Each flange 60 includes a cable engagement hole 62 that is centered about a handle pivot axis 64. The pivot axis 64 is the axis about which the pull handle 46 rotates when moved from its closed position to its open position. The cable engagement holes 62 are square or some other non-circular shape, the reason for which will be discussed below.

The pivot axis 64 is the center of a pivot joint 66 formed by the flanges 60 and a pivot support 68. The pivot support 68 may be a part of a handle chassis (not shown) located on the inside surface 42 of the outer panel 22, if so desired. The pivot support 68 may include a pair of pivot support legs 70 having a corresponding pair of circular bearing support holes 72. The pivot support 68 may include a pivot support mounting flange 73 that fixes the pivot support 68 relative to door structure, such as the door outer panel 22. Mounted in each of the bearing support holes 72 is a respective one of a pair of bearings 74. The bearings 74 have circular outer surfaces 76 that allow them to rotate in the bearing support holes 72, and square (or other non-circular shaped) cable engagement bores 78.

A torque cable 84 includes a handle engagement end 82 that has a square (or other non-circular shaped) outer surface 80 that corresponds to and engages the cable engagement holes 62 and the cable engagement bores 78. Accordingly, the handle engagement end 82, bearings 74 and flanges 60 are rotationally fixed to each other. The handle engagement end 82 of the torque cable 84 is centered about (i.e. coaxial with) the pivot axis 64, so both the pull handle 46 and handle engagement end 82 of the torque cable 84 pivot about this axis. The torque cable 84 may be flexible—rather than a rigid rod—since it merely needs to transmit torque along its length (discussed below). The torque cable extends to, and a second end 88 thereof, engages a release mechanism, such as a door latch assembly 86.

The operation of the outside handle assembly 44 will now be discussed. When one grasps and pulls on the hand gripping portion 52, the pull handle 46 will pivot about the handle pivot axis 64 until the stop flange 56 of the guide portion 54 abuts the stop block 58 on the door outer panel 22. The pull handle 46, of course, is moved from its closed to open position. As the pull handle 46 is moved between these two positions, the flanges 60 will pivot relative to the pivot support legs 70, while the flanges 60 of the pivot leg 50 will also rotate the handle engagement end 82 of the torque cable 84. Thus, the handle engagement end 82 rotates axially about the handle pivot axis 64. That is, "rotates axially" means that the rotation of the handle engagement end 82 is coaxial with the handle pivot axis 64, which of course induces a torque in the torque cable 84. The torque induced in the torque cable 84 by the rotation of the engagement end 82 is transmitted through the torque cable 84 to the door latch assembly 86, which releases a door latch (not shown). Upon releasing the hand gripping portion 52, a return spring (not shown) may be employed to cause the pull handle 46 to return to its closed position. The pivot axis 64 and sliding leg 48 are oriented such that the pull handle motion from the closed to the open position is generally horizontal.

As one can see, the pull force created when the pull handle 46 is moved from its closed to open position is converted into a torque in the torque cable 84, which is transmitted to the door latch assembly 86. Preferably, this is accomplished with an acceptable amount of pull effort on the handle 46. As compared to conventional bell crank mechanisms actuated by the pull handle, the force transmission point is moved from the rear part of the handle where a bell crank is used to actuate a push rod, to the front pivot area to take advantage of the leverage available to the handle lever.

One skilled in the art will recognize that the embodiment disclosed herein is but one way to practice the invention. For example, the guide portion 54, stop flange 56 and stop block 58 are merely an example of one way to guide the sliding leg 48, and other structure that guides and limits the maximum travel of the sliding leg 48 may be employed instead, if so desired. Also, the support structure around the handle pivot axis 64 is merely an example of structure that may be employed—other structure that supports the pull handle 46 while allowing it to rotate the torque cable 84 about the handle pivot axis 64 may be employed instead, if so desired. In addition, while the example embodiment of the present invention is described as being applied to a horizontally pulled outside handle as opposed to a conventional pull up outside type handle, it can be applied to pull up and other types of handles if so desired. Moreover, when referring to the term vehicle door, it may be other than a door for entering and exiting the vehicle, such as, for example, a glove box door, a removable panel concealing a compartment, or some other panel where the handle and torque cable are employed to selectively actuate the release mechanism.

While certain embodiments of the present invention have been described in detail, those familiar with the art to which this invention relates will recognize various alternative designs and embodiments for practicing the invention as defined by the following claims.

What is claimed is:

1. A handle assembly for a vehicle door including a pivot support having a flange that is rotationally fixed relative to the door, the handle assembly comprising:

a pull handle including a sliding leg, a pivot leg and a hand gripping portion extending between the sliding leg and the pivot leg, the sliding leg adapted to guide the pull handle between a closed position and an open position;

a torque cable having a first end rotationally fixed to the pivot leg and configured to operatively engage the flange to allow for axial rotation relative to the flange about a handle pivot axis about which the pull handle is pivotable, the first end being coaxially aligned with the handle pivot axis and rotatable axially about the handle pivot axis when the pull handle moves between the closed position and the open position, and a second end adapted to operatively engage a release mechanism; and wherein the pivot leg is secured to the torque cable for pivoting about the handle pivot axis.

2. The handle assembly of claim 1 wherein the handle assembly includes a bearing configured to rotatably mount to the pivot support and support the torque cable, the first end of the torque cable has a square shaped cross section, and the pivot leg includes a cable engagement hole that has a square shape and operatively engages the square shaped cross section of the first end.

3. The handle assembly of claim 2 wherein the sliding leg includes a guide portion slidable through a slider hole in a door outer panel, and a stop flange adapted to engage a stop block on the door outer panel when the pull handle is in the open position.

4. The handle assembly of claim 1 wherein the sliding leg includes a guide portion slidable through a slider hole in a door outer panel, and a stop flange adapted to engage a stop block on the door outer panel when the pull handle is in the open position.

5. The handle assembly of claim 1 wherein the handle pivot axis and the sliding leg are oriented to cause the pull handle to move through a generally horizontal motion between the closed position and the open position.

6. The handle assembly of claim 1 wherein the torque cable is a flexible cable.

7. The handle assembly of claim 1 wherein the release mechanism is a door latch assembly.

8. The handle assembly of claim 7 wherein the handle assembly is an outside handle assembly, and the pull handle is mountable on an outer surface of the vehicle door.

9. The handle assembly of claim 1 wherein the handle assembly is an outside handle assembly, and the pull handle is mountable on an outer surface of the vehicle door.

10. A vehicle door comprising:

a door outer panel including a handle pocket located between a slider hole and a pivot hole, and including a pivot support having a first flange that is rotationally fixed relative to the door and a first bearing mounted to the first flange that is pivotable relative to the first flange about a handle pivot axis;

a pull handle including a sliding leg extending through the slider hole, a pivot leg extending through the pivot hole, and a hand gripping portion extending between the sliding leg and the pivot leg, the sliding leg adapted to guide the pull handle between a closed position and an open position, the pivot leg pivotable about the handle pivot axis about which the pull handle is pivotable; and a torque cable having a first end mounted to the first bearing, rotationally fixed to the pivot leg at the handle pivot axis and being coaxially aligned with the handle pivot axis and axially rotatable about the handle pivot axis when the pull handle moves between the closed position and the open position, and a second end operatively engaging a door latch assembly.

11. The vehicle door of claim 10 wherein the first end of the torque cable has a square shaped cross section, and the pivot leg includes a cable engagement hole that has a square shape and operatively engages the square shaped cross section of the first end.

12. The vehicle door of claim 10 wherein the door outer panel includes a stop block mounted on an inner surface adjacent to the slider hole, and the sliding leg includes a guide portion adapted to slide through the slider hole and a stop flange engageable with the stop block when the pull handle is in the open position.

13. The vehicle door of claim 10 wherein the first end of the torque cable is rotationally fixed to the first bearing.

14. The vehicle door of claim 10 wherein the pivot support includes a second flange that is spaced from the first flange and rotationally fixed relative to the door and a second bearing mounted to the second flange that is pivotable relative to the second flange about the handle pivot axis.

15. The vehicle door of claim 14 wherein the pivot leg extends between the first and second flanges and is rotationally fixed to the first end of the torque cable between the first and second flanges.

16. The vehicle door of claim 10 wherein the torque cable is a flexible cable.

17. A method of actuating a door latch assembly of a vehicle door having a pivot support comprising the steps of:

providing a pull handle pivotable about a handle pivot axis between a closed position and an open position;

providing a torque cable having a first end supported by and pivotable relative to the pivot support, rotationally fixed to the pull handle at the handle pivot axis, coaxially aligned with the handle pivot axis and pivotable by the pull handle about the handle pivot axis, and a second end operatively engaging the door latch assembly;

pivoting the pull handle from the closed position to the open position; and axially pivoting the first end of the torque cable as the pull handle is pivoted from the closed position to the open position, inducing a torque in the second end of the torque cable.

18. The method of claim 17 including the step of preventing pivoting of the pull handle away from the closed position when the pull handle is in the open position.

19. The method of claim 17 wherein the step of pivoting the pull handle is further defined by the pull handle pivoting in a generally horizontal motion.

* * * * *